United States Patent [19]

Stottmann et al.

[11] Patent Number: 4,601,429

[45] Date of Patent: Jul. 22, 1986

[54] CONCENTRIC DRIVE FOR FOOD PROCESSING TOOL

[75] Inventors: Richard L. Stottmann, Troy; Edward F. Ponikwia, Dayton; William Weigl, Troy, all of Ohio

[73] Assignee: KitchenAid, Inc., St. Joseph, Mich.

[21] Appl. No.: 739,725

[22] Filed: May 31, 1985

[51] Int. Cl.[4] ..... B02C 18/18

[52] U.S. Cl. ..... 241/92; 241/282.2

[58] Field of Search ..... 241/92, 101.2, 282.1, 241/282.2, 278 R, 292

[56] References Cited

U.S. PATENT DOCUMENTS 4,227,655 10/1980 Williams .
4,456,184 6/1984 Williams et al. .
4,458,848 7/1984 Williams .

*Primary Examiner*—Mark Rosenbaum
*Attorney, Agent, or Firm*—Biebel, French & Nauman

[57] ABSTRACT

A concentric drive is provided for a food processing tool to permit a plurality of food processing heads to be removably associated with a single drive extension. Each food processing head comprises a disk member having cutting means for performing a desired food processing operation. The food processing head is formed by securing the disk-like member to a disk-mounting flange which extends axially and radially from the upper end of a disk-mounting hub having a D-shaped drive-receiving opening extending entirely therethrough with the remaining portion of the upper end being closed. The disk is flush-mounted to the flange in an orientation to present minimal interference between the cutting means and the hub and mounting flange and such that the hub is concentric with the disk-like member with the closed portion of the upper end of the hub extending to substantially the center of the disk-like member and spaced therefrom by the axial dimension of the disk-mounting flange to permit the cutting means to extend substantially to the center of the disk-like member. Alternate embodiments fuse the drive extension to the disk-mounting hub to produce a food processing tool which permits a cutting surface to extend from near the center of a disk-like member to near its periphery.

6 Claims, 8 Drawing Figures

CONCENTRIC DRIVE FOR FOOD PROCESSING TOOL

BACKGROUND OF THE INVENTION

This invention relates generally to food processors and, more particularly, to a concentric removable drive arrangement for food processing tools which, in its preferred form, permits a plurality of interchangeable food processing heads to be simply fitted onto a single drive extension such that only a single drive extension is required and the food processing tools can be packaged and stored in a compact form.

Food processors are a well known convenience for preparing food by slicing, grating, shredding or similar food processing operations. A conventional form of food processor includes a working bowl having a motor driven shaft projecting upwardly in the center of the bowl. A variety of food processing tools are coupled to the shaft and rotated to perform a corresponding variety of food processing operations as required by the operator of the food processor.

A detachable bowl cover is secured to the working bowl during operation of the food processor. The bowl cover defines a feed tube for introducing food items to be processed through the bowl cover into the bowl. Foods to be processed are placed into the feed tube and then pushed through the tube into engagement with a processing tool by means of a food pusher which is formed to be slidingly inserted into the feed tube.

The food processing tools each typically comprise a horizontal disk-like member formed of sheet metal, typically stainless steel, which is fixedly mounted on an extension shaft. The extension shafts of the food processing tools are formed such that they can be removably engaged with the driven shaft projecting upwardly in the center of the working bowl. Accordingly, when a food processing tool of this design is to be changed, the tool extension shaft is removed from the motor driven shaft and the extension shaft of the next tool to be utilized is then coupled to the motor driven shaft. Two problems associated with such prior art food processing tools have been recognized and addressed in the prior art.

Initially, the cutting length or effective food processing length of a disk-like member or disk over which food processing can be effected was limited by the way that the extension shaft was mounted to the disk. In particular, a centralized head of the extension shaft was concentrically mounted to the disk preventing the central portion of the disk from being used for food processing. Hence, the centralized head mounted to the disk limited the maximum cutting length or effective food processing length which could be provided by a given diameter disk. It was desired to be able to expand the food processing length to a maximum for each disk such that the food processing length would extend substantially from the center of the disk to its periphery, i.e., be approximately equal to the radius of the disk.

The extension of the effective processing length for a disk to approximately the radius of the disk was addressed by James E. Williams in U.S. Pat. No. 4,227,655. In Williams' food processing tool, the extension shaft, referred to as an elongated hub, extends between the motor driven shaft and an associated disk-like cutting member. To lengthen the effective processing length of a disk, a head of the elongated hub is offset radially from the axis of the motor driven shaft such that the head of the hub revolves around the axis of rotation of the motor driven shaft. By mounting the offset head of the elongated hub at a location which is radially offset from the center of the disk, food processing means can be provided on the disk from near its center to its periphery. Williams thus offered a solution to one problem of food processing tools by enabling larger food processing lengths and, hence, larger sized feed tubes to be used for a given diameter disk. In Williams' solution, however, each cutting member still had a full-length extension shaft secured to the member to form a food processing tool.

This leads to the second problem, namely, the fixedly-mounted full-length extension shafts which require a large amount of space for packaging or storage of the tool. It is apparent that once the offset head of the elongated hub of Williams or the centralized head of the concentric extension shaft of the earlier cutting tools is secured to a disk to form a stable food processing tool, the tool formed thereby effectively occupies a three dimensional box having a square base with sides equal in length to the diameter of the disk and a height equal to the length of the extension shaft or elongated hub.

The second problem has also been addressed in the prior art and two solutions have been patented with James E. Williams being a named inventor in U.S. Pat. Nos. 4,456,184 and 4,458,848. Both of these later Williams' patents are concerned with providing a food processing tool having a removable food processing head such that a plurality of food processing heads can be provided for interchangeable use with a single elongated hub. Both of Williams' later patents maintain the offset head mounting arrangement of his earlier patent such that the effective length of the processing tool can extend from near the center of a disk to its periphery.

Unfortunately, apparently due to the forces applied to the disk as a result of the offset attachment of the hub head to the disk, the food processing disks or heads must be securely interlocked to the elongated hub. Accordingly, in both the later Williams' patents, rather complicated arrangements are provided for interlocking the interchangeable food processing heads to the elongated hub. These interlocks appear to be a compromise for retaining the offset head of an elongated hub for mounting a disk or food processing head yet permitting the head to be removable and hence, interchangeable on the hub with other heads. The interlocks thus permit detachable engagement of the food processing heads with the offset head of the elongated hub, but are mechanically complex requiring considerable apparatus making the food processing tools more difficult and costly to manufacture than their simplier, fixed-head predecessor designs.

It is thus apparent that the need exists for a simple, removable head food processor tool which can extend the effective food processing length to approximately the radius of a disk-like member of the removable head and which occupies less space for packaging and storage without requiring complex and costly interlocks to hold the removable head to a drive extension.

SUMMARY OF THE INVENTION

In accordance with the present invention, a concentric drive arrangement is provided for food processing tools including a disk-like food processing member to provide an effective food processing length approximately equal to the radial dimension of the disk-like member. The concentric drive arrangement of the present invention eliminates the forces which are created by mounting the disk-like member to an offset head of an elongated hub as in the prior art. It also eliminates the complicated interlock arrangements required in accordance with removable head prior art designs to reduce the expense of a food processing tool including a single drive extension and a plurality of removable food processing heads. The plurality of removable food processing heads can be interchangeably mounted to the single drive extension to provide an effective extended processing length for the disks and reduced volume for packaging and storage of the food processing tools. Accordingly, larger feed tubes can be provided without enlarging the food processor and the food processing tools can be made with removable heads such that they occupy less space when not in use without increasing the bulk or complexity of the food processing tools.

In accordance with the preferred embodiment of the present invention, a food processing tool is provided for a food processor having a drive motor, a working bowl, a drive shaft projecting upwardly from the drive motor through the bowl for rotation of the food processing tool within the bowl, a bowl cover detachably secured to the bowl, and a feed tube for introducing food items into contact with the food processing tool and, hence, into the bowl. The food processing tool of this embodiment comprises a removable food processing head comprising a disk-like member having cutting means for performing a desired food processing operation on food items in contact with the cutting means as the disk-like member is rotated; a mounting hub having a drive-receiving opening extending entirely through the hub from a lower end to an upper end, the remaining portion of the upper end being closed; and, a disk-mounting flange which extends axially and radially primarily from the open portion of the upper end of the hub and defining an upper surface for essentially flush engagement with the disk-like member, the mounting flange being secured to the disk-like member to present minimal interference between the cutting means and the hub and mounting flange, in particular, such that the hub is concentric with the disk-like member and the closed portion of the upper end of the hub extends to substantially the center of the disk-like member and is spaced therefrom by the axial dimension of the disk-mounting flange to permit the cutting means to extend substantially to the center of the disk-like member and to overlay the closed portion of the upper end of the hub.

The food processing tool further comprises a drive extension having a lower end removably engageable with the drive shaft of the drive motor such that it is driven thereby and an upper end formed to be slidingly received within the hub and defining a drive member received within the drive-receiving opening and extending substantially to the upper surface of said disk-mounting flange. When mounted in the food processor, it is apparent that the drive extension is concentric with both the motor drive shaft and the disk-like member.

Preferably, the drive extension is hollow and open at both the lower end and the upper end, with the open upper end of the drive extension being covered by the disk-like member when the drive extension is engaged with the mounting hub for performing food processing operations. This preferred embodiment reduces contamination of the interior of the drive extension by food being processed, yet permits ready cleaning of the drive extension when removed from the disk-mounting hub.

In one embodiment of the food processing tool, the cutting means comprises a slicing knife and the mounting flange extends circumferentially at least 180°, but less than 270°, and is secured to the disklike member upstream from and closely adjacent to the slicing knife to leave the area downstream of the slicing knife free for passage of sliced food products into the bowl. In accordance with the present invention, the slicing knife extends from near the center of the disk-like member over the closed upper end of the mounting hub to near the periphery of the disk-like member. Preferably, the drive member and the drive-receiving opening are D-shaped.

In alternate embodiments of the present invention, a food processing tool is provided which permits a cutting surface to extend from near the center of the disk member to near its periphery by means of an elongated hub which is concentrically aligned with the motor drive shaft and the disk-like member. In accordance with these embodiments, a food processing tool comprises a disk-like member having cutting means for performing a desired food processing operation on food items in contact with the cutting means as the disk-like member is rotated; an elongated mounting hub having a lower end concentrically engageable with the drive shaft of a food processing drive motor to be driven thereby and an upper end having at least a portion thereof closed; and a disk-mounting flange which extends axially and radially from a portion of the upper end of the elongated mounting hub and defines an upper surface for flush engagement with the disk-like member, the mounting flange being secured to the disk-like member in an orientation to present minimal interference between the cutting means and the elongated hub and mounting flange and, in particular, such that the elongated hub is concentric with the disk-like member and the closed portion of the upper end of the elongated hub extends to at least the center of the disk-like member and is spaced therefrom by the axial dimension of the disk-mounting flange to permit the cutting means to extend substantially to the center of the disk-like member.

It is, therefore, an object of the present invention to provide an improved concentric removable drive arrangement for a food processing tool such that a plurality of food processing heads having cutting surfaces extending from near their centers to their peripheries can be interchangeably engaged with a drive extension which concentrically drives the associated food processing tool such that complex interlocking arrangements are unnecessary and yet the food processing heads may be utilized in conjunction with a single drive extension and may be compactly packaged and stored with the drive extension removed from the food processing heads.

It is another object of the present invention to provide an improved elongated hub concentric drive arrangement for connection to a disk-like member having cutting surfaces extending from near its center to it periphery to form a food processing tool.

Other objects and advantages of the invention will be apparent from the following description, the accompanying drawings and the appended claims.

DETAILED DESCRIPTION OF THE INVENTION

Figure 1:
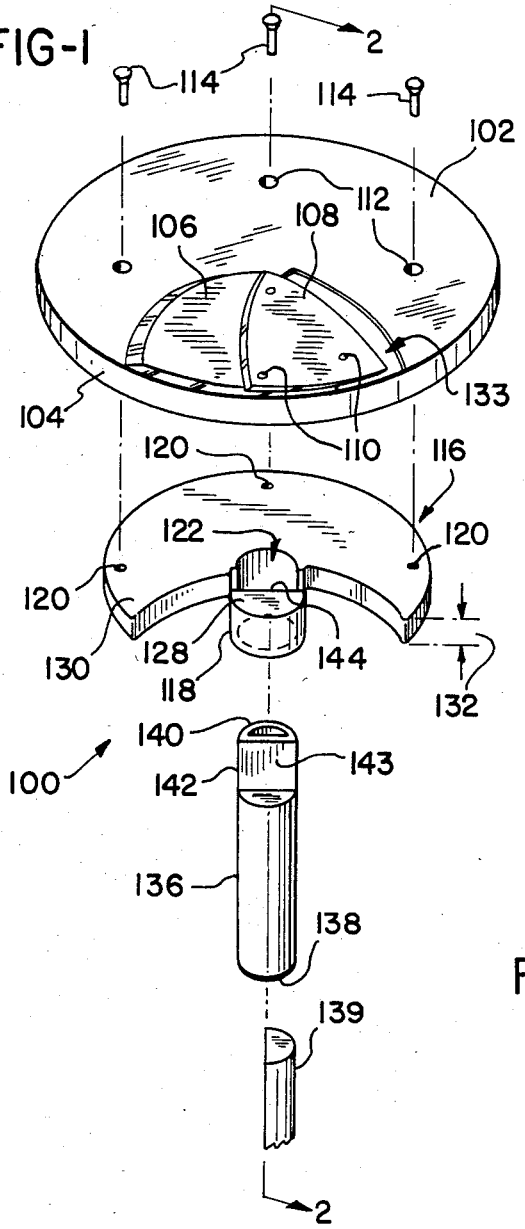
FIG. 1 is an exploded view of a food processing tool incorporating the preferred embodiment of the present invention.

FIG. 1 shows an exploded view of the preferred embodiment for a concentric drive arrangement for a food processing tool 100 in accordance with the present invention. The food processing tool 100 of FIG. 1 includes a disk-like food processing member 102 which is preferably formed of stainless steel sheet metal and has a reinforcing flange 104 formed around its perimeter. The disk-like member 102 includes cutting means for performing a desired food processing operation. In the illustrated embodiment, the cutting means comprises a slicing knife and the disk-like member 102 includes a raised platform 106 for receiving a sharp cutting blade 108 which is secured thereto by means of spot welds 110 to form the slicing knife.

The disk-like member 102 includes three mounting holes 112 through which flat headed rivets 114 are passed to secure the disk-like member 102 to a disk-mounting flange 116 which extends axially and radially from a mounting hub 118. The rivets 114 pass through the holes 112 in the disk-like member 102 and matching holes 120 in the mounting flange 116 to secure the disk thereto. By using the flat headed rivets 114, there are no protrusions above the upper surface of the disk-like member 102 except for the cutting means.

The disk-mounting hub 118 includes a drive-receiving opening 122 extending entirely through the hub 118 from a lower end 124 to an upper end 126 as best seen in FIGS. 2-6. The remaining portion 128 of the upper end 126 of the disk-mounting hub 118 is closed as shown. The disk-mounting flange 116 extends axially and radially primarily from the open portion of the upper end 124 of the disk-mounting hub 118 and defines an upper surface 130 for flush engagement with the undersurface of the disk-like member 102.

The mounting flange 116 is secured to the disk-like member 102 in a position to present minimal interference between the cutting means, the mounting hub 118 and the disk-mounting flange 116. In particular, when the disk-like member 102 is secured to the disk-mounting flange 116, the disk-mounting hub 118 is concentric with the disk-like member 102 and the closed portion 128 of the upper end 126 of the mounting hub 118 extends to substantially the center of the disk-like member 102 and is spaced therefrom by the axial dimension 132 of the disk-mounting flange 116 to permit the cutting means to extend substantially to the center of the disk-like member 102. The described minimal interference positioning is best illustrated in FIG. 1 and in FIG. 2 where the passage of food through a food processing opening 133 of the disk-like member 102 near its center is illustrated by the arrow 134.

Figure 2:
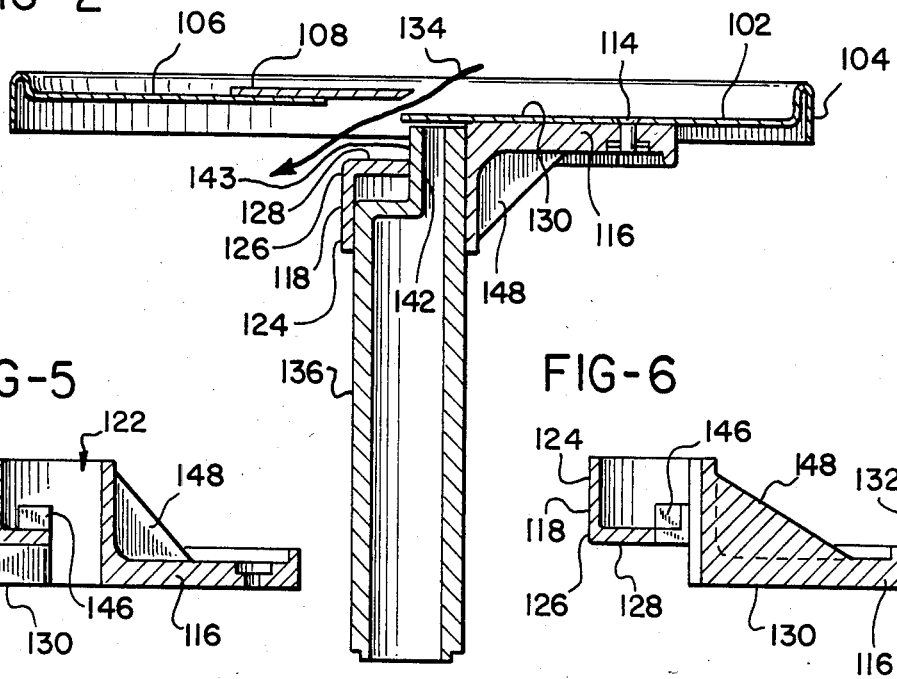
FIG. 2 is a cross-sectional view through the food processing tool of FIG. 1, as assembled.
Figure 5:
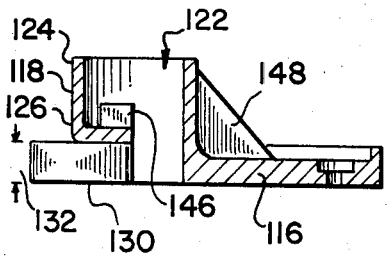
FIGS. 5 and 6 are sectional views taken along the lines 5—5 and 6—6, respectively, of FIG. 4.
Figure 6:
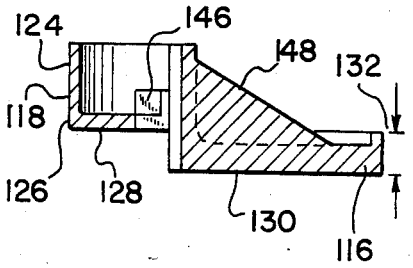
Figure 3:
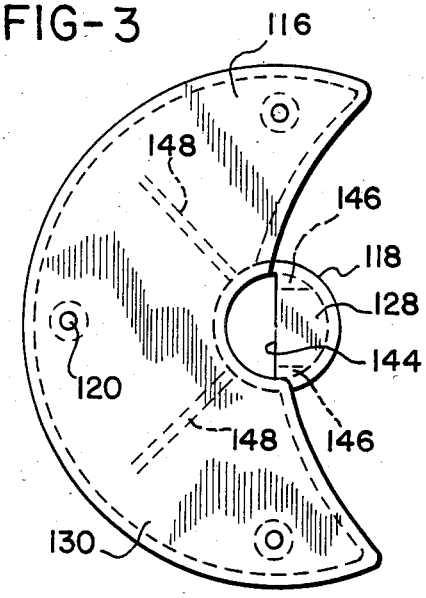
FIGS. 3 and 4 are top and bottom views, respectively, of a disk-mounting hub and associated disk-mounting flange of the preferred embodiment of the present invention.
Figure 4:
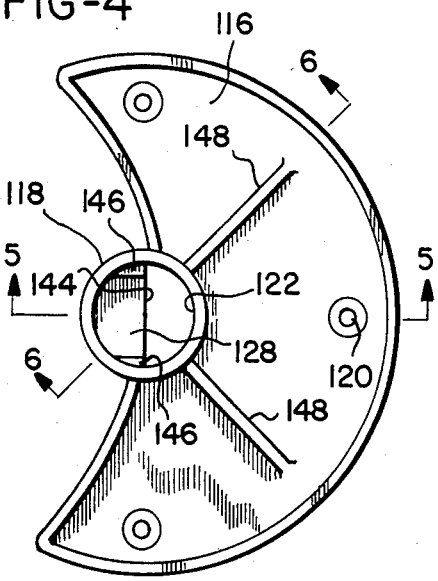

The food processing tool 100 further comprises a drive extension 136 having a lower end 138 which is removably engageable with a drive shaft 139 of a drive motor for a food processor as is well known in the art and illustrated, for example, in the above-identified U.S. patents which are hereby incorporated by reference such that the drive extension may be selectively driven by the food processor drive motor. An upper end 140 of the drive extension 136 is formed to be slidingly received within the disk-mounting hub 118 and defines a drive member 142 received within the drive-receiving opening 122 of the disk-mounting hub 118. The drive member 142 extends substantially to the upper surface of the disk-mounting flange 116 as best shown in FIG. 2. When the food processing tool 100 is mounted in a food processor, it is apparent that the drive extension 136 is concentric with both the motor drive shaft 139 and the disk-like member 102.

Preferably, the drive extension 136 is hollow and open at both the lower end 138 and the upper end 140. The open upper end 140 of the drive extension 136 is covered by the disk-like member 102 when the drive member 142 of the drive extension 136 is fully engaged with the drive-receiving opening 122 of the disk-mounting hub 118, for example, for performing food processing operations. This preferred formation of the drive extension 136 reduces contamination of the interior of the drive extension 136 by food being processed, yet permits ready cleaning of the drive extension 136 when removed from the disk-mounting hub 118.

Preferably, the drive member 142 and the drive-receiving opening 122 of the mounting hub 118 are D-shaped, as shown; however, other driving shapes will be apparent to those skilled in the art. When a D-shaped drive is utilized, a flat driving face 143 of the drive member 142 of the drive extension 136 is engaged by a flat driving face 144 of the closed portion 128 of the upper end 126 of the disk-mounting hub 118. The driving face 144 is reinforced by drive extensions 146 formed within the disk-mounting hub 118. In the illustrated embodiment, the disk-mounting flange 116 is reinforced and further secured to the disk-mounting hub 118 by means of two reinforcing webs 148. Of course, additional reinforcing webs or alternate reinforcing arrangements could be utilized in the present invention.

In the illustrated embodiment of the food processing tool 100, the cutting means comprises a slicing knife formed by securing the cutting blade 108 to the raised platform 106 of the disk-like member 102. The mounting flange 116 extends circumferentially at least 180°, but less than 270° around the disk-mounting hub 118, and is secured to the disk-like member 102 upstream from and closely adjacent to the cutting blade 108 to leave the area downstream from the cutting blade 108 free for passage of sliced food products into a working bowl of the food processor. In accordance with the present invention, the slicing knife or other cutting means extends from near the center of the disk-like member 102 over the upper closed portion 128 of the disk-mounting hub 118 to near the periphery of the disk-like member 102. The relief provided beneath the center of the disk-like member 102 is of particular importance for selected cutting elements located near the center of the disk-like member 102 for grating, shredding and other food processing operations.

Figure 7:
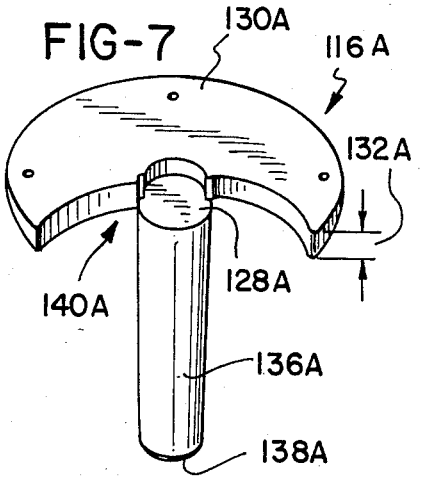
FIGS. 7 and 8 show alternate embodiments of the present invention.
Figure 8:
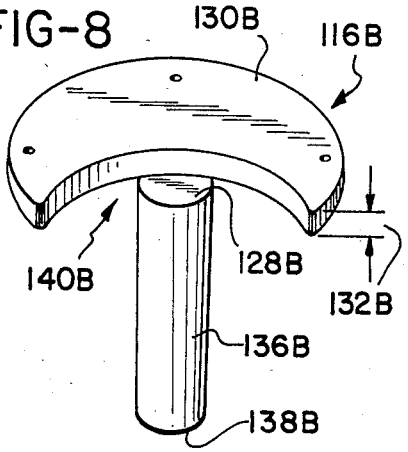

FIGS. 7 and 8 show alternate embodiments of the present invention. With these embodiments, a food processing disk-like member, such as the disk-like member 102, may be fixedly mounted to an extension shaft to form a food processing tool which permits a cutting surface to extend from near the center of the disk-like member to near its periphery by means of an elongated hub which is concentrically aligned with the drive shaft of a motor of a food processor and the disk-like member.

In accordance with the embodiments shown in FIGS. 7 and 8, a food processing tool is formed by securing a disk-like member having food processing cutting means for performing a desired food processing operation onto an elongated mounting hub 136A,136B having a lower end 138A,138B which is concentrically engagable with the drive shaft 139 and an upper end 140A,140B having at least a portion 128A,128B thereof closed. The disk-like member is secured to a disk-mounting flange 116A,116B which extends axially and radially from a portion of the upper end 140A,140B of the elongated mounting hub 136A,136B and defines an upper surface 130A,130B for flush engagement with the disk-like member.

The embodiments of FIGS. 7 and 8 are secured to the disk-like member as previously described with respect to the preferred embodiment shown in FIGS. 1–6 to present minimal interference between the cutting means of the disk-like member and the elongated hub and mounting flange. In particular, the elongated hub 136A,136B is concentric with the disk-like member and the closed portion 128A,128B of the upper end 140A,140B of the elongated hub 136A,136B extends to at least the center of the disk-like member and is spaced therefrom by the axial dimension 132A,132B of the disk-mounting flange 116A,116B to permit the cutting means to extend substantially to the center of the disk-like member.

In accordance with the preferred embodiment of the present invention shown in FIGS. 1–6, a plurality of food processing heads each comprising a disk-like member 102 having an appropriate food processing surface and an associated disk-mounting hub 118 and flange 116 which are secured thereto may be provided for a food processing machine. Only a single drive extension 136 needs to be provided since the food processing heads may be interchangeably secured to the drive member 142 of the upper end 140 of the drive extension 136 for performing the variety of food processing operations offered by the plurality of food processing heads. In accordance with the preferred embodiment of FIGS. 1–6, the food processing heads and associated single drive extension may be compactly stored or packaged for shipment and, as is apparent, no complex and costly interlocks are required to hold the removable food processing heads to the drive extension due to the concentric alignment of the drive arrangement.

While the forms of apparatus herein described constitute preferred embodiments of this invention, it is to be understood that the invention is not limited to these precise forms of apparatus, and that changes may be made therein without departing from the scope of the invention which is defined in the appended claims. For example, the disk-like member and the drive extension could be molded as a single piece with a cutting blade attached to the disk-like member or food processing cutting means formed into the surface of the disk-like member. Such equivalent embodiments and modifications are considered to be within the scope of the present invention.

What is claimed is:

1. In a food processor having a drive motor, a working bowl, a drive shaft projecting upwardly from said drive motor through said bowl for rotation of a food processing tool within said bowl, a bowl cover detachably secured to said bowl, and a feed tube extending substantially to the center of said drive shaft for introducing food items into contact with said food processing tool and hence into said bowl, a food processing tool comprising:

a removable food processing head comprising:

a disk-like member having cutting means for performing a desired food processing operation on food items in contact with said cutting means as said disk-like member is rotated;

a mounting hub having a drive-receiving opening extending entirely through said hub from a lower end to an upper end, the remain ing portion of said upper end being closed; and a disk-mounting flange integral with the mounting hub which extends axially and radially primarily from the open portion of the upper end of said hub and defining an upper surface for essentially flush engagement with said disk-like member, said disk-mounting flange being secured to said disk-like member in an orientation to present minimal interference between said cutting means and said hub and mounting flange and, in particular, such that said hub is concentric with said disk-like member and the closed portion of the upper end of said hub extends to substantially the center of said disk-like member and is spaced therefrom by the axial dimension of said disk-mounting flange to permit said cutting means to extend substantially to the center of said disk-like member and to overlay the closed portion of the upper end of said hub; and a drive extension having a lower end removably engageable with said drive shaft to be driven thereby and an upper end formed to be slidingly received within said hub and defining a drive member received within said drive-receiving opening and extending substantially to the upper surface of said disk-mounting flange, said drive extension being concentric with said drive shaft and said disk-like member.

2. A food processing tool as claimed in claim 1 wherein said drive extension is hollow and open at both said lower end and said upper end thereof to permit ready cleaning of said drive extension when removed from said disk-mounting hub, said open upper end of said drive extension being covered by said disk-like member when said drive extension is engaged with said disk-mounting hub for food processing operations to reduce contamination of the interior of said drive extension by food being processed.

3. A food processing tool as claimed in claim 2 wherein said cutting means comprises a slicing knife, said disk-mounting flange extends circumferentially at least 180°, but less than 270°, and is secured to said disk-like member upstream from and closely adjacent to said slicing knife thereby leaving the area downstream of said slicing knife free for passage of sliced food products into said bowl, said slicing knife extending from near the center of said disk-like member over the closed upper end of said hub to near the periphery of said disk-like member.

4. A food processing tool as claimed in claim 3 wherein said drive member and said drive-receiving opening are D-shaped.

5. In a food processor having a drive motor, a working bowl, a drive shaft projecting upwardly from said drive motor through said bowl for rotation of a food processing tool within said bowl, a bowl cover detachably secured to said bowl, and a feed tube for introducing food items into contact with said food processing tool and hence, into said bowl, a food processing tool comprising:

a disk-like member having cutting means for performing a desired food processing operation on food items in contact with said cutting means as said disk member is rotated;

an elongated mounting hub having a lower end concentrically engageable with said drive shaft to be driven thereby and an upper end having at least a portion thereof closed; and a disk-mounting flange integral with the mounting hub which extends axially and radially from a portion of the upper end of said elongated mounting hub and defining an upper surface for flush engagement with said disk-like member, said mounting flange being secured to said disk-like member in an orientation to present minimal interference between said cutting means and said elongated hub and mounting flange and, in particular, such that said elongated hub is concentric with said disk-like member and said closed portion of the upper end of said elongated hub extends to at least the center of said disk-like member and is spaced from said disk-like member by the axial dimension of said disk-mounting flange to permit said cutting means to extend substantially to the center of said disk-like member.

6. A food processing tool as claimed in claim 5 wherein said cutting means comprises a slicing knife, said disk-mounting flange extends circumferentially at least 180°, but less than 270°, and is secured to said disk-like member upstream from and closely adjacent to said slicing knife thereby leaving the area downstream of said slicing knife free for passage of sliced food products into said bowl, said slicing knife extending from near the center of said disk-like member over the closed upper end of said hub to near the periphery of said disk-like member.

* * * * *